United States Patent [19]

Tuttle et al.

[11] Patent Number: 4,944,829

[45] Date of Patent: Jul. 31, 1990

[54] APPARATUS FOR APPLYING WRAPPERS

[75] Inventors: Kenneth A. Tuttle, Horsham; James Corrado, Coopersburg, both of Pa.

[73] Assignee: Rorer Pharmaceutical Corporation, Ft. Washington, Pa.

[21] Appl. No.: 338,117

[22] Filed: Apr. 14, 1989

[51] Int. Cl.[5] ..... B65C 9/25

[52] U.S. Cl. ..... 156/497; 156/320; 156/499; 156/566; 156/DIG. 26; 156/DIG. 28; 156/DIG. 36

[58] Field of Search ..... 156/458, 497, 499, 566, 156/320, DIG. 11, DIG. 21, DIG. 26, DIG. 28, DIG. 36

[56] References Cited

U.S. PATENT DOCUMENTS

| | | | |
|---|---|---|---|
| Re. 23,828 | 5/1954 | Von Hofe . | |
| 2,449,298 | 9/1948 | Hoppe . | |
| 2,524,945 | 10/1950 | Von Hofe . | |
| 2,621,823 | 12/1952 | Perry | 156/DIG. 36 |
| 2,676,726 | 4/1927 | Von Hofe . | |
| 2,722,332 | 11/1955 | Carter | 156/320 |
| 2,829,791 | 4/1958 | Berst . | |
| 2,849,933 | 9/1958 | Von Hofe . | |
| 2,952,376 | 9/1960 | Orloff . | |
| 3,157,555 | 11/1964 | Newman . | |
| 3,231,448 | 1/1966 | Flood . | |
| 3,232,804 | 2/1966 | Klopfenstein | 156/320 |
| 3,736,208 | 5/1973 | Kraft et al. . | |
| 3,904,466 | 9/1975 | Jones et al. | 156/497 |
| 4,097,325 | 6/1978 | Schnier | 156/497 |
| 4,427,744 | 1/1984 | Hume, III | 156/320 |
| 4,724,029 | 2/1988 | Kontz | 156/497 |

*Primary Examiner*—Joye L. Woodard

*Attorney, Agent, or Firm*—Rorer Group Inc.

[57] ABSTRACT

A wrapper to be wrapped around a stack of disc-like tablets includes a portion carrying a layer of heat-activatable adhesive, which is activated just prior to wrapping the wrapper around the stack to secure it in position on the stack. The heat activation is provided by a short, hot blast of air directed onto a surface of the wrapper opposite that on which the heat-activatable layer is located, whereby the applied heat must travel through a portion of the wrapper to reach the adhesive layer and activate it. The air blast is heated by heaters which include elongated heat exchangers having rectangular grooves or slots extending along the length of their outer surfaces, through which grooves the air blast is constrained to travel for efficient, rapid heating.

5 Claims, 6 Drawing Sheets

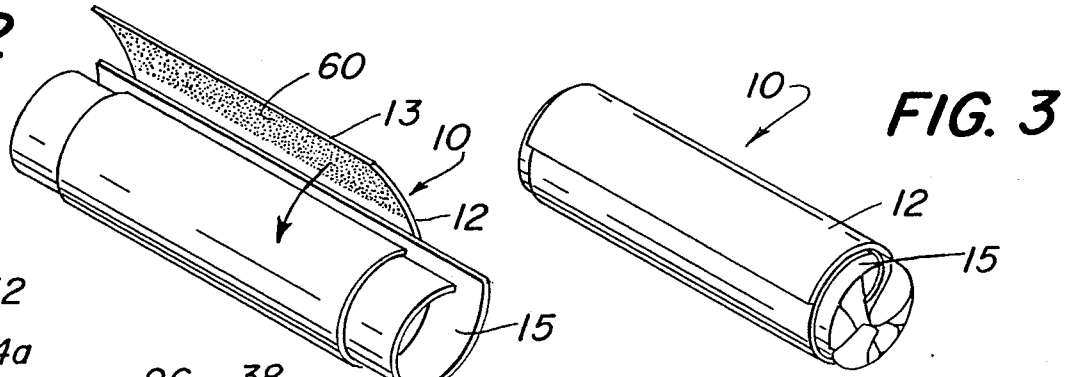
FIG. 2
FIG. 3
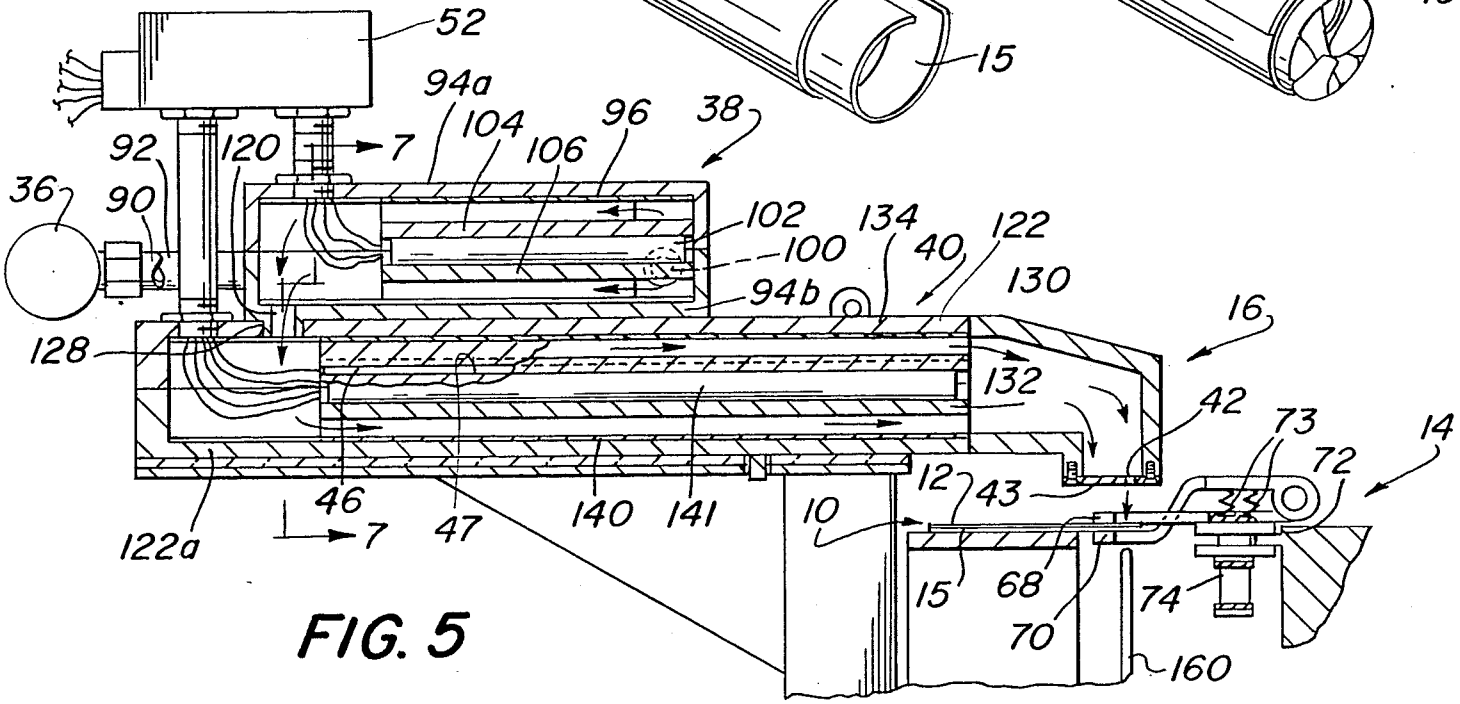
FIG. 5

FIG. 7
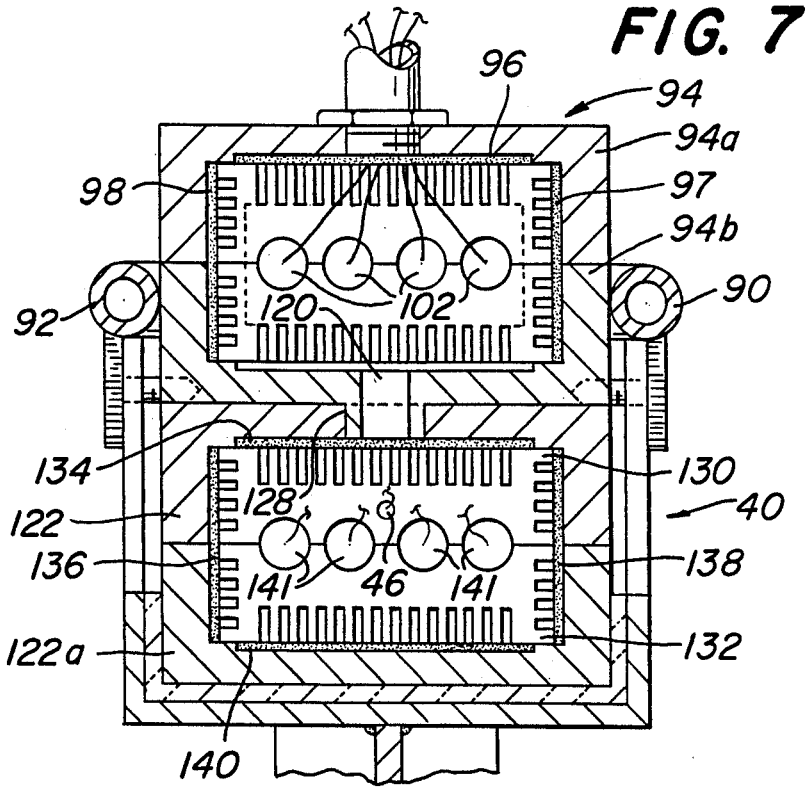
FIG. 10
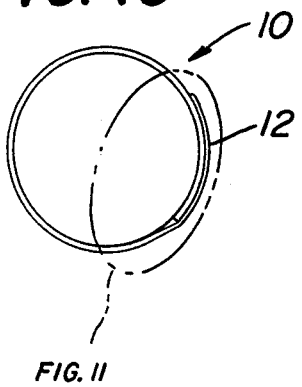
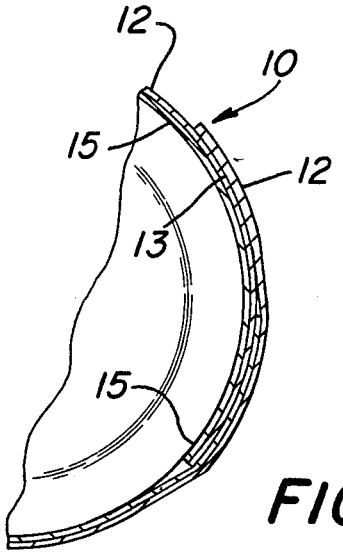
FIG. 11

APPARATUS FOR APPLYING WRAPPERS

BACKGROUND OF THE INVENTION

This invention relates to apparatus for securing wrappers around generally cylindrical objects, for example around stacks of disc-like tablets.

Apparatus is known in the prior art which will receive a train of wrappers and a train of generally cylindrical objects such as a stack of disc-like tablets, and which will secure the wrappers to and around the exterior cylindrical surface of the objects. More specifically, it is known in the prior art to advance each of the successive cylindrical objects and each of the corresponding wrappers into a wrapping machine which wraps the wrapper entirely around the exterior of the object and secures it in place. To accomplish this, a gluing wheel has been used to lay down a layer of glue on the underside of the wrapper just prior to wrapping, so that when the wrapper is wrapped around the object and overlapped somewhat upon itself, it is glued in the desired position.

It has also been proposed to use as the wrapper a paper-like material coated on one surface with a layer of a heat-activatable adhesive, and instead of applying glue to the wrapper, applying a blast of hot air directly to the heat-activatable layer just prior to the wrapping operation, whereby upon completion of the wrapping the wrapper is again secured around the object.

The latter type of system is disclosed in U.S. Pat. No. 2,952,376, issued Sept. 13, 1960 to Daniel L. Orloff, which discloses the application of labels to round bottles by using a label having a thermally-activatable layer on one surface thereof and applying a blast of hot air to a portion of the heat-activatable surface just prior to application of the label to the bottle. The times and durations of the air blasts may be controlled by a solenoid valve, and the blast is released through a series of holes in a tube overlying the position assumed by the label just prior to wrapping; heating elements are housed in the air-blast supplying tube.

While this type of arrangement may be suitable for some purposes, it has been found to be inapplicable to certain classes of wrapper-applying machines. For example, in one known commercial type of machine with respect to which the present invention will be described in detail, it has been deemed not practical to apply a blast of hot activating air to the exposed heat-activatable heated layer, because of space and other practical considerations.

It is therefore an object of the present invention to provide a new and useful method and apparatus for the application of an encircling band of flexible sheet material (herein referred to as a wrapper) to the exterior of a generally cylindrical object.

Another object is to provide such method and apparatus which are capable of functioning reliably at a high rate of speed in a commercial production environment.

It is also an object to provide such method and apparatus which do not require that the hot air blast be applied directly to the heat-activatable layer on the sheet or label, and which therefore can be utilized in situations where such application would be inconvenient or impossible.

A still further object of the invention is to provide a new, especially compact apparatus for providing an air blast of very high temperature and very short duration, suitable for use in the above-identified method and apparatus.

SUMMARY OF THE INVENTION

These and other objects and features of the invention are attained by the provision of a system in which a wrapper is provided on one of its surfaces with a layer of heat-activatable adhesive material, and a short, high-blast of hot air is used to heat the heat-activatable layer to above its activation temperature, just prior to application of the wrapper to the object to which it is to be secured. However, the blast of hot air is applied not to the side of the wrapper on which the heat-activatable adhesive layer is located, but to the opposite side, so that the heat must be transferred through the main wrapper to the heat-activatable layer. This enables the hot-air blast method of activation to be utilized in equipment such as that shown and described in detail hereinafter, in which it is inconvenient or impractical to apply such an air blast directly to the heat-activatable layer.

In order to provide the high temperatures and short durations of air blast required to heat the layer by heat transfer through the wrapper, a new and useful air heater means is preferably employed which comprises an outer casing surrounding an elongated heat exchanger which containing within it longitudinally-extending heater elements. The elongated heat exchanger is provided with longitudinal surfaces which are smooth, flat and longitudinally grooved so as to provide longitudinally-extending fins adapted for good heat exchange with the surrounding air. By this construction, very high temperatures of air can be reached rapidly, while still permitting a rapid movement of the air through the heat exchanger as is desired to produce a very short hot-air blast. Preferably, this air heater means is provided with a nozzle containing apertures adapted to direct the hot air blast onto the underlying wrapper. In a preferred form of the invention the nozzle is provided with a quick-disconnect arrangement so that nozzles having aperture arrays of different configurations may be readily substituted, for different purposes at different times, as desired.

BRIEF DESCRIPTION OF FIGURES

These and other objects and features of the invention will be more readily understood for a consideration of the following detailed description, taken with the accompanying drawings, in which corresponding parts are designated by corresponding numerals, and in which:

FIG. 2 is a perspective view showing a generally cylindrical object, which may be a stack of disk-like tablets, with a wrapper wrapped part-way around it;

FIG. 3 is the same type of view as in FIG. 2, but shows the wrapper completely wrapped around the object, and in its final adhering position;

FIG. 5 is a vertical sectional view taken along lines 5—5 of FIG. 4;

FIG. 7 is a vertical sectional end view taken along lines 7—7 of FIG. 5, showing especially the air-heater system;

FIG. 10 is a schematic cross-sectional view of the rolled-up wrapper of foil and paper, and;

FIG. 11 is an enlarged fragmentary view of a portion of the wrapper of FIG. 10, showing more clearly in cross-section the actual disposition of typical layers after they have been wrapped and secured in place around the stack of tablets.

DETAILED DESCRIPTION OF SPECIFIC EMBODIMENTS

Figures 1, 1A:
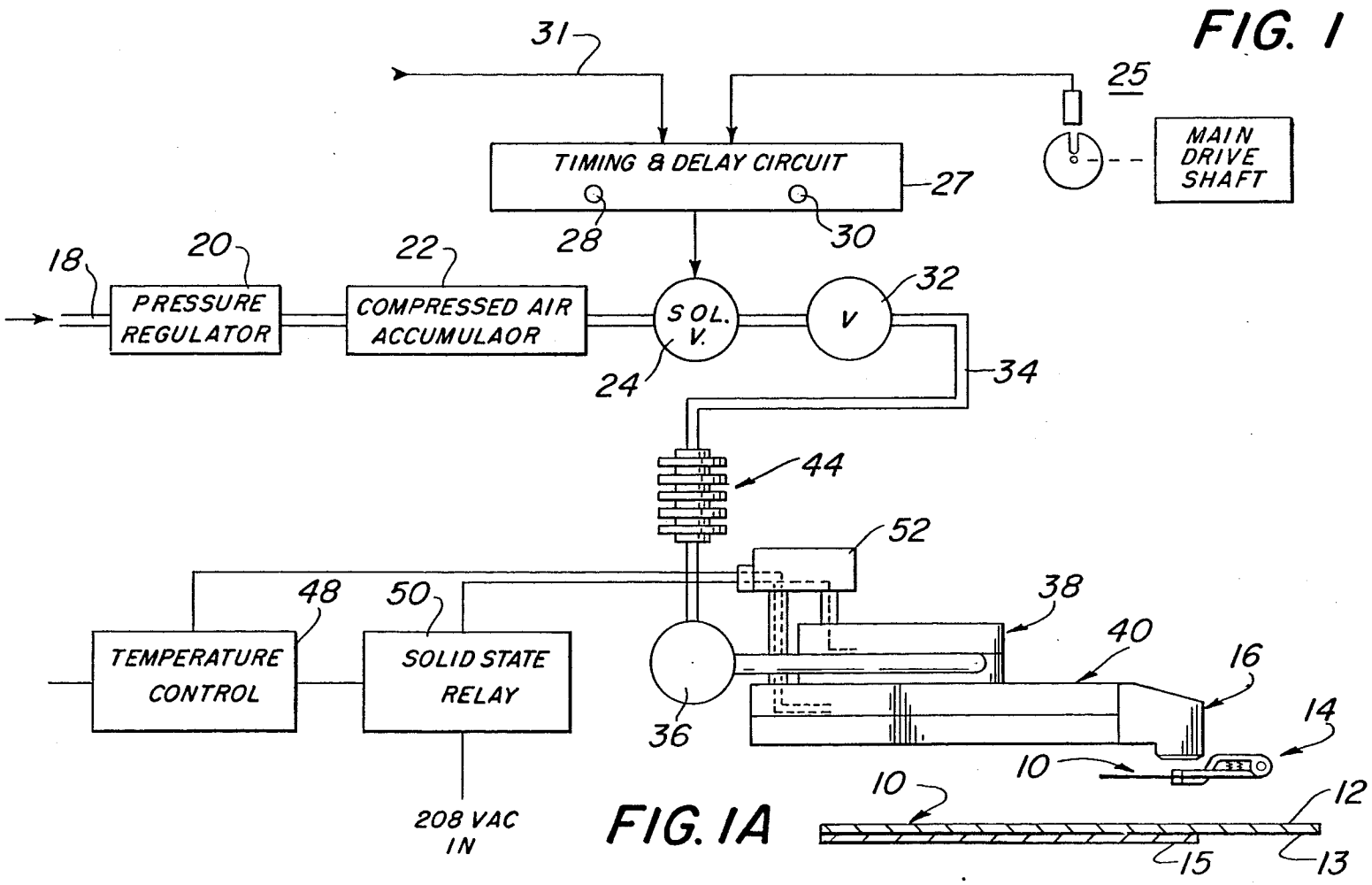
FIG. 1 is a schematic diagram showing a system for applying short, high-temperature blasts of hot air to one surface of a wrapper, the opposite surface of which is heat-activatable to exhibit adhesive properties.
FIG. 1*a* is an enlarged cross-sectional view of a typical wrapper with a heat-activatable layer, usable for the purposes of the invention.
Figure 4:
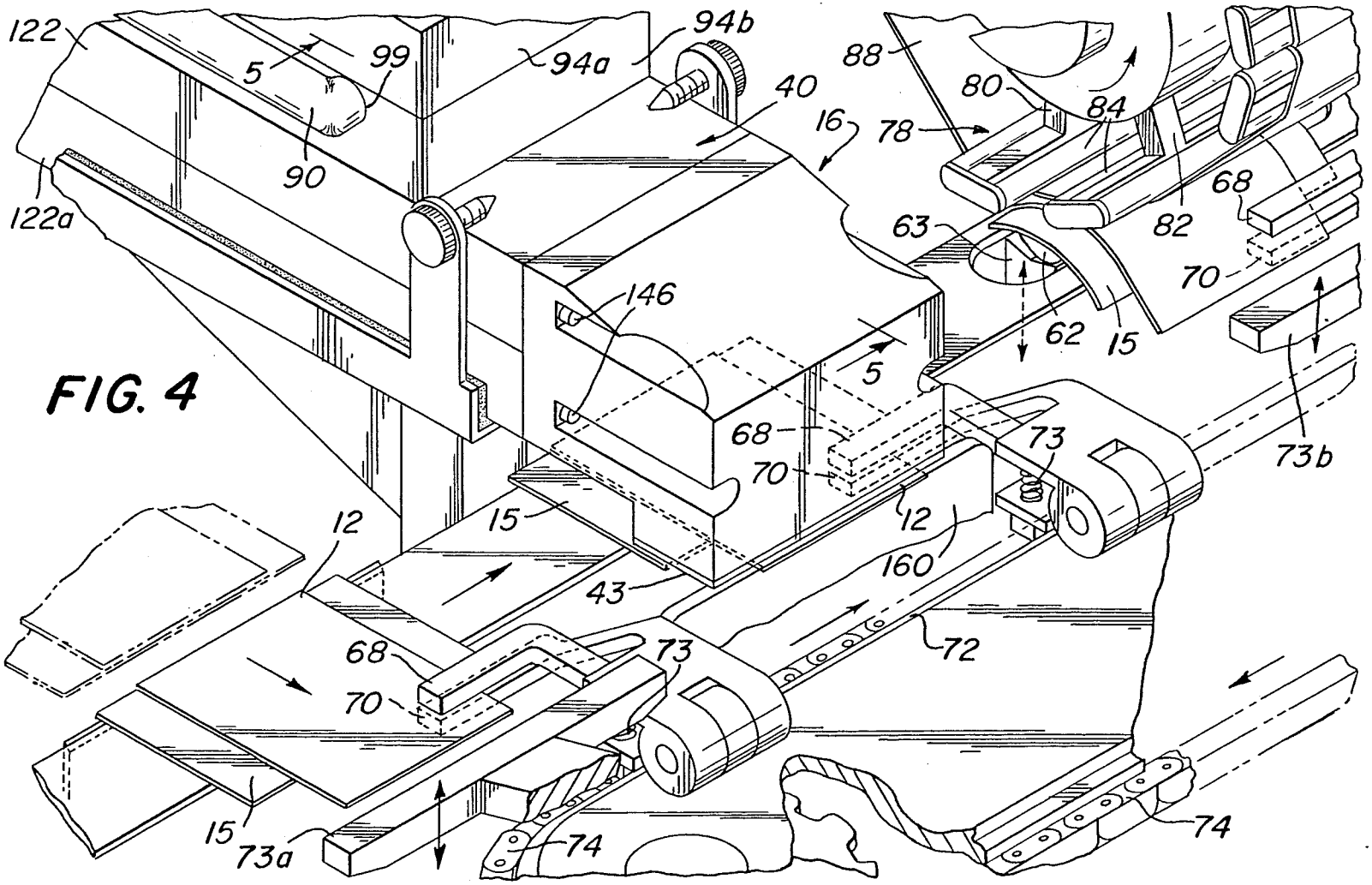
FIG. 4 is a fragmentary perspective view of a machine incorporating and utilizing the apparatus and method of the present invention.

Considering now the particular preferred embodiment of the invention shown only by way of example in the accompanying drawings, and without thereby limiting the scope of the invention, FIGS. 1, 1*a* and 4 show a rectangular wrapper 10 comprising a layer of paper 12 having a heat-activatable adhesive layer 13 on its lower surface, together with an underlying separate foil layer 15. The wrapper is held in a spring-biased two-finger gripper 14 which moves the wrapper into position under a hot-air blast nozzle 16, as will be described more fully in connection with the other figures.

The hot-air blast is provided to nozzle 16 from any convenient compressed air supply 18 by way of a pressure regulator 20, which acts to hold the input pressure at a desired level, e.g. around 50 psi. The pressure regulator supplies air to a conventional compressed air accumulator 22 and thence to a solenoid valve 24, which is turned on and off automatically once each time a wrapper is placed under the air blast nozzle. The timing for the actuation of the solenoid valve is controlled from a proximity sensor 25 which, once per machine cycle, produces an electrical signal indicative of the angular position of the main drive shaft for the conveyor carrying the grippers.

The electrical signal from the proximity sensor is supplied to an electrical control circuit 27, which responds by delivering a control pulse to the control element of the solenoid valve 24 to turn it on; a pulse of about 200 to about 300 milliseconds duration at about 110 volts a.c. is typical for this purpose. The control circuit may be a personal computer positioned between the proximity sensor and the solenoid valve to permit other special control functions to be injected into the system, but such elaborate control circuitry is not necessary for the simple basic purpose of turning the air blasts on and off at appropriate times during the dwell of each wrapper beneath the air blast nozzle. Basically, the proximity sensor produces an electrical signal slightly before the gripper and wrapper stop under the air-blast nozzle, and a "valve open" control 28 may be provided for manual control of the delay between the time of the proximity sensor signal and the start of the air-blast, while a "close valve" control 30 may be provided to control the duration of the air-blast. Conventional analog or digital timing and delay circuits may be used for these purposes.

Also preferably provided is a label-feed signal on the input line 31 to circuits 27, which provides a disabling signal to prevent turning-on of the solenoid valve when wrappers are not being delivered to the system, as during a temporary shut-down. A manually-adjustable valve 32 receives the output of the solenoid valve 24 when the latter valve is turned on and enables manual adjustment of the rate of air flow through the air conduit means 34 (in this case ordinary metal pipes) to the air manifold 36 and the preheater 38 when the solenoid valve is on.

The pre-heater delivers its pre-heated air into the main heater 40, from which it passes through heater nozzle 16 and through apertures 42 in its bottom plate 43, and thence (see FIG. 6) onto the top of wrapper 10. A heat sink 44 in the form of a metal body with external radiating fins is preferably provided on the exterior of the piping just upstream of the manifold 36 to minimize the transfer of heat from the heaters into the remainder of the system.

A temperature sensor 46 (see FIGS. 6 and 7) located in an axial bore 47 in the main heater is connected to temperature controller 48, which monitors the temperature in the heater and controls solid-state relay 50 so that the temperature of air in the heater is maintained at a predetermined desired value. A typical power input to the solid state relay is about 208 volts a.c., and the temperature control typically operates to hold the temperature of the heat exchanger at a predetermined value in the range of about 700° to about 900° Fahrenheit.

The wiring connections for the heating elements and for the temperature sensor are in this example provided within a wiring block 52, from which appropriate wires run to the various electrical components associated with the meters.

The overall general operation may then be appreciated with respect to FIG. 1. Each time a wrapper is moved into position beneath the hot-air blast nozzle 16, the proximity sensor 25 signals the control circuit 27 to turn on solenoid valve 24 for a predetermined short interval of time, thereby applying a hot air blast through the preheater 38 and the main heater 40, and thence through the nozzle 16 on to the upper surface of the wrapper 10, for a predetermined time and at a predetermined high temperature. For the case of a wrapper using a paper layer 12 about 4 to 5 mils in thickness and made of suitable paper stock such as 55-lb. Krome Kote, with a heat-activatable adhesive layer 13 of Brownbridge 441-BL adhesive thereon, an air blast of about 200 milliseconds duration at about 825° Fahrenheit is preferred, with good results being obtained in other useful embodiments using pulse durations of from about 200 to about 300 milliseconds and temperatures typically from about 700° to about 900°F.; the higher temperatures are generally used with the shorter durations, to achieve the desired activation.

The detailed views shown in the other Figures relate largely to the known apparatus for producing and transferring the wrappers and for wrapping them around stacks of disk-like tablets, with the important exception of the arrangement for activating the adhesive by supplying a short hot-air blast to that side of the wrapper which is not coated with the heat-activatable adhesive layer. In this example, the metallic foil portion 15 (see FIG. 1*a*), is retracted somewhat from the leading edge of the wrapper, as is conventional, and the system for forming this two-ply combination in this configuration is well known and commercially available. The machine depicted in the Figures may be the Model *S*-2000 *Auto Wrapper* made by *Norwich LTD. of Norwich, England.*

FIG. 2 shows by its stippled area the portion 60 of the heat-activatable layer 13 on the the underside of the paper which is heat-activated by the air blast, and FIG. 3 shows the wrapper after it has been made to encircle completely the generally cylindrical stack 62 of disk-like tablets to form a tightly-adhered outer wrapper, and after the foil has been folded inwardly at its ends to complete the package as desired.

FIG. 11 shows in even more detail the combination of the paper layer 12 and metallic foil 15 wrapped around the stack in overlapping relationship, with the overlying portion of the paper adhered to the underlying paper portion by the heat-activated material.

As will be apparent from the foregoing, the heating occurs in a very short time from the side of the wrapper which does not have the heat-activatable layer on it, and it is for this reason, primarily, that extremely high temperatures must be developed and used.

Considering in more detail the particular preferred embodiment shown in FIG. 4, there is shown the paper layer 12 and the underlying foil layer 15, which by known, conventional means typified by the above-identified Norwich machine have been cut and arranged so that the overlying paper layer 12 extends at its forward end beyond the foil 15. When the wrapper reaches the position shown, the previously-open gripper fingers 68 and 70 close, to seize the wrapper. The gripper fingers then move along the track 72 on endless chain 74 (to the right in FIG. 4) with an intermittent motion, so that the grippers stop to close upon the wrapper, then advance downstream to the next stop position where the wrapper is held beneath the apertures in the heater nozzle 16. The hot-air blast typically begins about a few milliseconds before the wrapper has stopped beneath the air blast nozzle, and the gripper arms resume their motion to carry the wrapper out of the heating system about a few milliseconds before the air blast stops. The gripper arms then move the wrapper into position beneath the wrapping machine 78, shown in perspective in FIG. 4 and in more detail in FIGS. 8 and 9.

Figure 8:
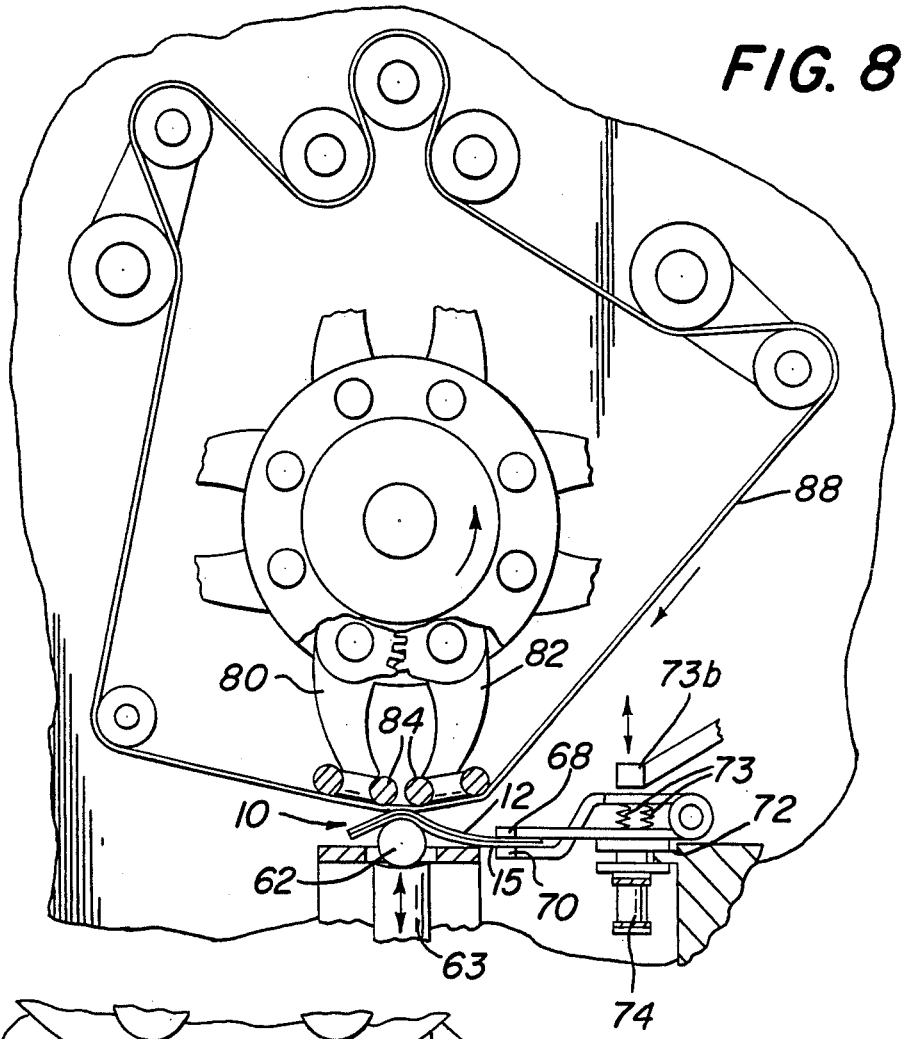
FIG. 8 is a fragmentary cross-sectional view of a wrapping machine suitably employed in the apparatus of FIG. 4, shown as it appears just prior to entrance of a wrapper into it.

Since the wrapping machine 78 is in this example a conventional, commercial Norwich machine, it need not be described in detail. It may be seen, in general, that it comprises a pair of mutually-pivotable arms 80 and 82 each carrying rollers such as 84. As shown in FIG. 8, the stack of tablets 62 is automatically moved upwardly beneath the wrapper 10 by elevator 63 into the region between arms 80 and 82, and by the action of the continuously moving belt 88 the wrapper is wrapped around the stack of tablets to produce the desired complete enclosure, with the activated adhesive edge of the wrapper overlapping the underlying portion of the wrapper. Just prior to this action, the fingers of the gripper automatically separate to release the wrapper so it they may take part in the above-described operation. Automatic means not a part of the present invention may pick up the wrapped stacks, close the foils at their ends, and move them away for subsequent handling.

FIGS. 4–7 show the preferred form of heating means for use in this system. Referring to all of these Figures, it will first be seen that the air-blast is delivered to manifold 36, and thence by way of two pre-heater inlet lines 90 and 92 into opposite sides of the far end of the pre-heater.

Figure 6:
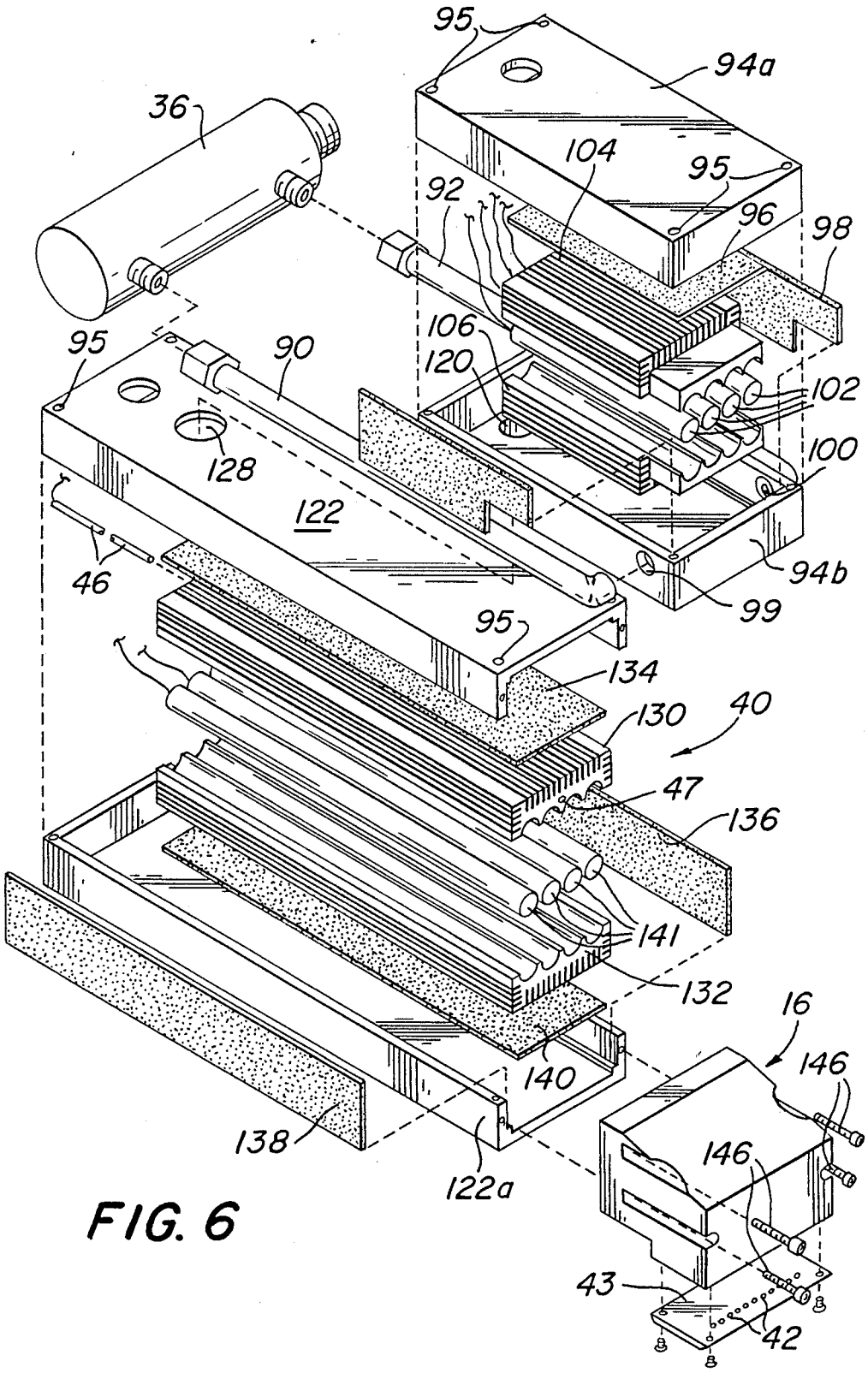
FIG. 6 is an exploded view of a portion of the system of FIG. 4, showing especially the air-heater system itself.

The pre-heater comprises a casing 94 made up of two separable parts, a top casing **94*a* and a bottom casing 94B, held together by appropriate screws extending through screw holes such as 95 in FIG. 6. The interior of the tops and the sides of the pre-heater are lined with insulating panels 96, 97 and 98, the side panels being cut back at their lower right-hand ends in FIG. 6 to permit passage to the interior of the hot air entering through the inlets 99 and 100**.

The origin of the heat in the pre-heater is the set of four insulated, rod-like, electric heating elements 102, extending longitudinally along the pre-heater near its center. The heater elements are seated in conforming circular grooves in upper and lower pre-heater heat-exchange elements 104 and 106, which are generally U-shaped in cross-section and fit against each other to completely encircle the heating rods. The heat exchanger elements may be of any suitable heat-conductive material such as stainless steel.

Each heat exchanger element is provided with rectangular grooves on each of its exposed surfaces, extending longitudinally thereof and of the pre-heater itself, so as to increase the area of hot metal exposed to the hot air. The air passes through the grooves in travelling from the pre-heater inlets 99 and 100 to the single pre-heater outlet 120 at the opposite ends of the heater elements. The heat exchanger elements fit closely against the insulating panels and against the bottom casing 94B, so that the air is compelled to travel through the narrow, longitudinally-extending grooves in the heat-exchanger elements and will be efficiently and quickly heated.

It is noted that the grooved portion of each heat exchanger element is cut back from the end thereof nearer the pre-heater inlet, so that the adjacent end of the interior of the pre-heater can serve as a plenum, by virtue of which the inlet air can circulate laterally sufficiently to have free access to the inlet ends of all of the exchanger grooves.

The main heater 40 has an upper and a lower metallic casing 122,122A respectively and the pre-heater sits directly on top of it. The outlet opening 120 of the preheater is aligned directly with the inlet opening 128 of the main heater, and the flow of air is therefore from the preheater through main heater inlet 128 and then through the grooves in main heat exchanger elements 130 and 132 within the main heater to the nozzle 16.

The heat-exchanger elements 130 and 132 inside the main heater are similar to those in the pre-heater. In this case insulating panels 134, 136, 138 and 140 are positioned along the interior, at both sides and at the top and bottom of the casing, and the left-hand ends of the heat exchangers as viewed in FIG. 6 are recessed from the adjacent wall of the casing so as to permit inlet air to have access to the inlet ends of all of the grooves in the heat exchanger elements. The latter heat exchanger elements are of the same cross-sectional form as those in the pre-heater, and they fit closely against the insulating panels so that again the air is constrained to pass through the multiple longitudinally-extending grooves in the upper and lower heat exchanger elements; the source of heating comprises the four insulated electrical heating rods such as 141.

The detachable air-blast nozzle 16 is secured to the downstream end of the main heater, as by suitable screws such as 146. The passage within the nozzle in this example provides a right-angle turn of the air flow, directing it downwardly through the row of apertures such as 42 extending through a bottom closure plate 43 for the nozzle. The row of holes 42 is positioned so as to overlie that portion of the heat-activatable wrapper which is to be heated by the air blast through the holes.

Figure 9:
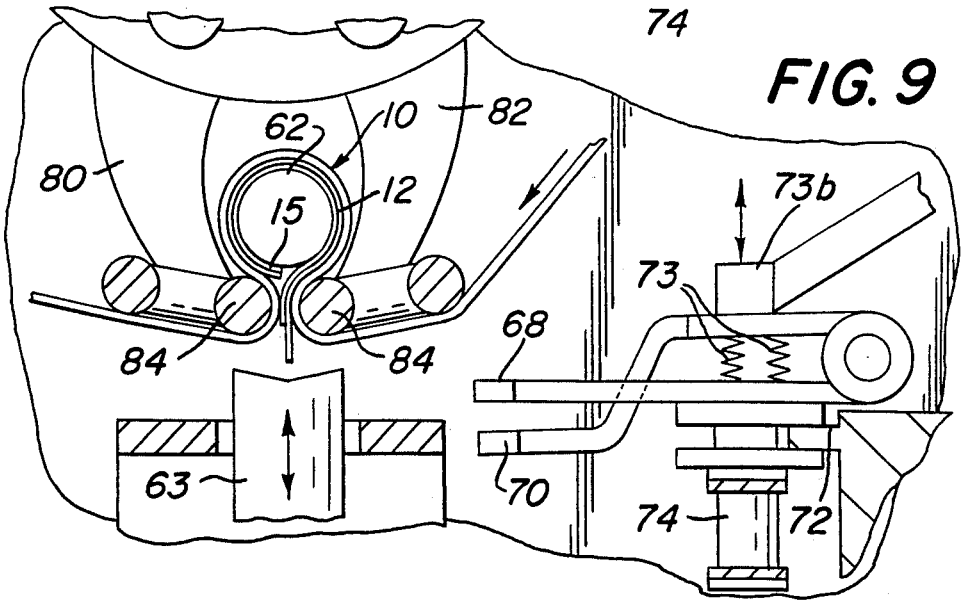
FIG. 9 is a similar, but further enlarged, view of the wrapping machine, showing the wrapper already within it and wrapped substantially completely around the cylindrical object.

FIG. 4 shows some of the conventional elements of the system in somewhat more detail. It will be understood that when there is a gripper at the pick-up position, another gripper is holding a label in position for impingement by the air blast under the nozzle 16, and another gripper holding still another wrapper for insertion into the wrapping machine; the chain drive is operated intermittently so that each gripper stops momentarily at each of these three positions during normal operation, that is, each gripper stops to pick up the paper-like wrapper and the associated foil, then starts up to move to the position under the nozzle 16 where it stops to receive the air blast, and is then moved into position beneath the wrapper. Grippers like the three shown are disposed at equal intervals around the continuous long chain 74. FIGS. 4, 8 and 9 show particularly clearly the arrangement of springs 73 tending to hold the gripper jaws closed, and cam rails 73*a* and 73*b* which open the jaws to acquire and to release the label.

To provide support for the paper portion of the wrapper and the underlying foil during lateral movement, a horizontal support strip 160 is provided, extending along the direction of motion of the wrappers and along which the wrapper can slide during this motion.

There has therefore been provided an apparatus in which a wrapper having a heat-activatable layer on one side thereof is impinged by a short, high-temperature air blast on the surface thereof directly opposite the portion which is to be rendered adhesive, and is then wrapped about a generally cylindrical object so that the heat-activated portion of the wrapper secures the wrapper to the object, as desired.

The desired short, but very high, temperature blasts are provided by means of the special heaters shown, through which the air is passed at the appropriate times, and which comprise heat exchangers having a plurality of longitudinal grooves through which the air is constrained to pass, so as to provide rapid heating without impeding the rapid flow of the air blast.

The duration, rate of flow and temperature of the air blast are adjusted to provide the desired activation of the adhesive layer, and different combinations of values of these parameters may be selected in various specific applications of the invention.

The drawing shows a single row of air-blast discharge apertures in the discharge nozzle 16, but it will be understood that any of a variety of arrays of apertures, or even a single aperture or slit, may be found preferable in various applications of the invention. The nozzle bottom plate is preferably made easily replaceable to permit changing of the aperture array as desired.

Also, any of a variety of foils, or no foil at all, may be used. In the present example of a preferred embodiment the foil may be a commercial foil made by Reynolds Metals Co. and comprising lamina of tissue and aluminum alloy foil, bonded together; suitable for this purpose is Reynolds stock No. 11-C2C1133-C2C298-GP-BALM 342-DR1235-O-CS1A11506-P/15B51GP.

While the invention has been described with particular reference to specific embodiments thereof in the interest of complete definiteness, it may be embodied in a variety of forms diverse from those specifically shown and described, without departing from the spirit and scope of the invention.

What is claimed is:

1. Apparatus for securing a wrapper to each of a train of cylindrical objects with the wrapper extending at least partly around the circumference of each said object, said wrapper having a heat-activable adhesive layer on at least a portion of one side thereof, said apparatus comprising:

means for forming a moving train of said wrappers;

air-blast means supplied with said train of wrappers for applying a short blast of hot air against the surface of each successive wrapper of said train at a position opposite said portion of said one side to activate said heat-activatable adhesive layer on said portion by heat transmission through said wrapper;

means for forming a train of said objects; and wrapping means supplied with said train of objects and with said train of wrappers from said air-blast means for wrapping each of said wrappers received from said air-blast means around one of said objects to adhere it thereto.

2. The apparatus of claim 1, in which said wrapper is of a non-metallic material having a thickness of about 4 to 5 mils, and in which the duration of said blast is about 200–400 milliseconds.

3. The apparatus of claim 1, wherein said air-blast means comprises heat-exchanger means; conduit means for supplying air to said heat-exchanger means; heating means within said heat-exchanger means; and heat sink means in heat-exchange relation with said conduit means and located adjacent said heat-exchanger means for dissipating heat reaching said conduit means from said heating means.

4. The apparatus of claim 3, wherein said air-blast means comprises solenoid valve means responsive to control signals applied thereto to form said blasts of air through said heat-exchanger means.

5. The apparatus of claim 1, wherein said air-blast means comprises: a casing; upper and lower elongated metal heat-exchange elements disposed within said casing and having mating surfaces with complementary longitudinal grooves extending along the lengths of their mating surfaces, said elements having heating means disposed within and extending along the lengths of said grooves; a plurality of longitudinal slots formed in the exterior surfaces of said heat-exchange elements; a nozzle connected to one end of said casing; and means for supplying a blast of air to the end of said casing opposite from said nozzle for travel through said slots to said nozzle.

* * * * *